United States Patent [19]

Walker

[11] Patent Number: 4,897,890

[45] **Date of Patent: * Feb. 6, 1990**

[54] AIR CONTROL SYSTEM FOR AIR BED

[76] Inventor: Robert A. Walker, 8700 W. 36th St., Minneapolis, Minn. 55426

[ * ] Notice: The portion of the term of this patent subsequent to May 16, 2006 has been disclaimed.

[21] Appl. No.: 859,866

[22] Filed: May 2, 1986

Related U.S. Application Data

[63] Continuation of Ser. No. 455,664, Jan. 5, 1983, abandoned.

[51] Int. Cl.[4] ..... A47C 27/10

[52] U.S. Cl. ..... 5/453; 5/443; 5/455; 137/536; 417/413

[58] Field of Search ..... 5/453, 454, 455, 61, 5/68, 81 R, 88; 417/413, 418, 417, 316, 317; 137/596, 565, 625.25, 625.67, 625.68

[56] References Cited

U.S. PATENT DOCUMENTS

| | | | |
|---|---|---|---|
| 388,037 | 8/1888 | Hargin . | |
| 795,108 | 7/1905 | Doellinger . | |
| 2,000,873 | 5/1935 | Arens . | |
| 2,136,510 | 11/1938 | Jensen | 277/26 |
| 2,245,909 | 6/1941 | Enfiajian . | |
| 2,769,182 | 11/1956 | Nunlist | 5/68 |
| 2,930,324 | 3/1960 | Toulmin | 417/413 |
| 2,998,817 | 9/1961 | Armstrong | 128/33 |
| 3,068,494 | 12/1962 | Pinkwater . | |
| 3,148,391 | 9/1964 | Whitney . | |
| 3,303,518 | 2/1967 | Ingram . | |
| 3,326,601 | 6/1967 | Vanderbilt et al. | 297/284 |
| 3,394,415 | 7/1968 | Parker . | |
| 3,426,373 | 2/1969 | Scott et al. . | |
| 3,462,778 | 8/1969 | Whitney . | |
| 3,587,568 | 6/1971 | Thomas | 128/33 |
| 3,605,138 | 9/1971 | Tucker | 5/90 |
| 3,623,485 | 11/1971 | Bowen | 128/402 |
| 3,701,173 | 10/1972 | Whitney . | |
| 3,775,781 | 12/1973 | Bruno et al. | 5/61 |
| 3,784,994 | 1/1974 | Kery . | |
| 3,822,425 | 7/1974 | Scales . | |
| 3,867,732 | 2/1975 | Morrell . | |
| 3,868,103 | 2/1975 | Pageot et al. | 137/596 |
| 4,074,373 | 2/1978 | Garofalo | 5/511 |
| 4,139,020 | 2/1979 | Sebo | 137/596 |
| 4,175,297 | 11/1979 | Robbins et al. | 5/284 |
| 4,190,286 | 2/1980 | Bentley | 297/284 |
| 4,224,706 | 9/1980 | Young et al. | 5/449 |
| 4,225,989 | 10/1980 | Corbett et al. | 5/453 |
| 4,309,153 | 1/1982 | Panick et al. | 417/413 |
| 4,394,784 | 7/1983 | Swenson et al. | 5/453 |

OTHER PUBLICATIONS

"BEDDING" Magazine, Sep., 1981, cover page and pages 28 and 30.

*Primary Examiner*—Vinh Luong
*Attorney, Agent, or Firm*—Burd, Bartz & Gutenkauf

[57] ABSTRACT

An air pump having a diaphragm moved with a solenoid operates to supply air under pressure to air mattresses of an air bed. A hand control having a pair of valves functions to control the operation of the air pump to supply air to the air mattresses and vent air from the air mattresses.

20 Claims, 3 Drawing Sheets

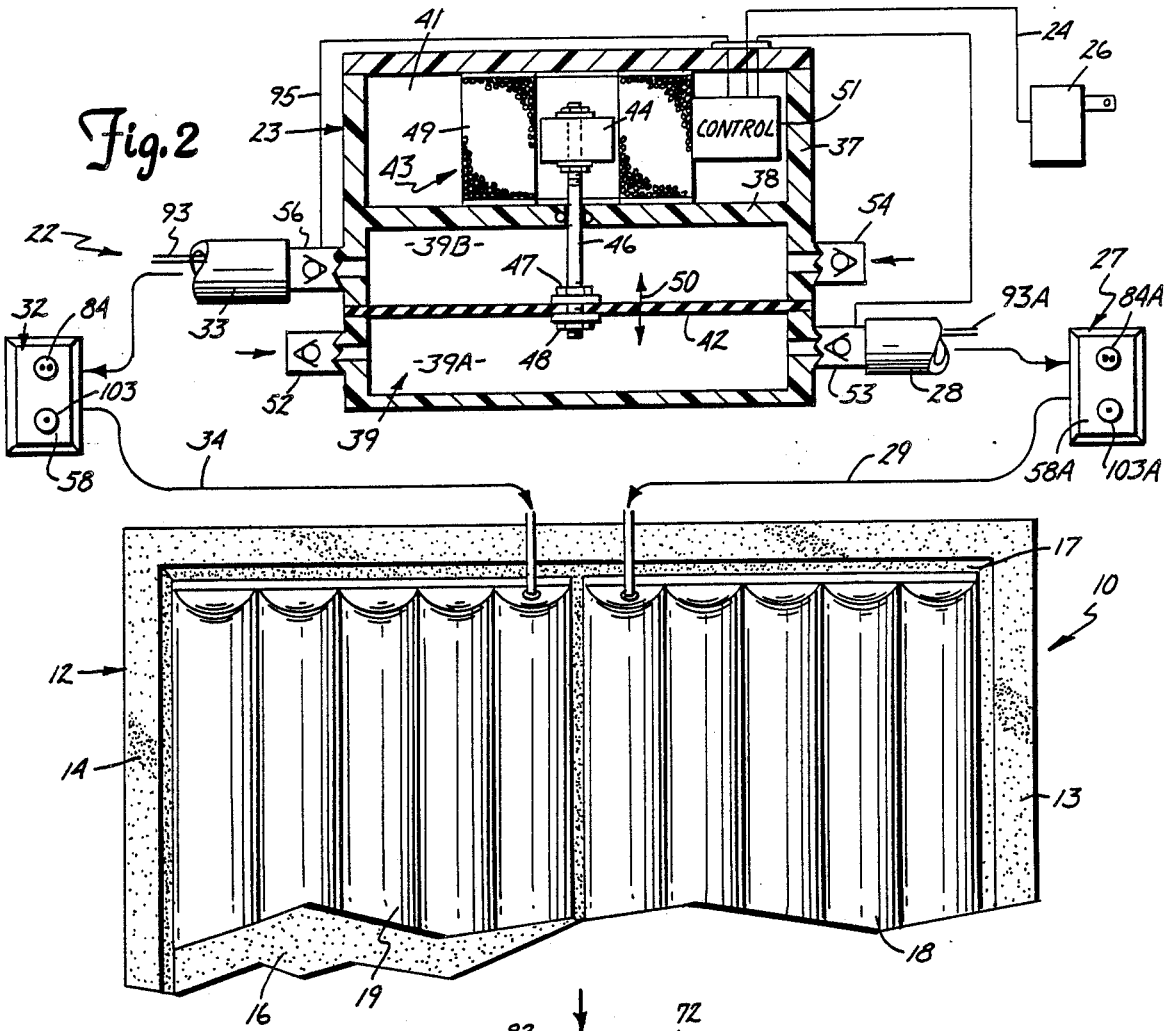
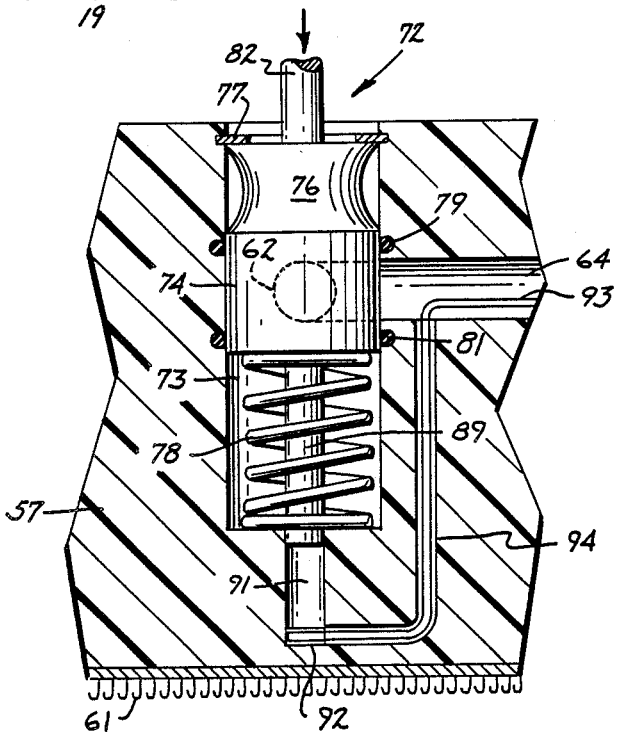
Fig. 7

AIR CONTROL SYSTEM FOR AIR BED

This application is a continuation of U.S. application Ser. No. 455,664 filed Jan. 5, 1983, now abandoned.

TECHNICAL FIELD

The invention relates to fluid pumps and valve and switch controls associated with the pumps for regulating fluid pressure in one or more fluid accommodating structures. More particularly, the invention is directed to air pumps and hand controls for supplying air under pressure to air mattresses and adjusting the pressure of the air in the air mattresses.

BACKGROUND OF THE INVENTION

Air mattresses are used with cots and beds to provide yieldable body supports. The air mattresses are inflated with pumps, such as hand operated pumps and bag pumps. Motor driven blowers and pumps have also been used to supply air under pressure to air mattresses. The biasing or firmness characteristics of an air mattress is determined by the pressure of the air in the air mattress. The air mattress firmness can be varied by supplying additional air or venting air from the air mattress. Control mechanisms have been used to adjust the inflation of air mattresses. Young et al. in U.S. Pat. No. 4,224,706 discloses a mechanism for adjusting the amount of air in an air mattress. The mechanism includes bladders connected to air mattresses for supplying air to and receiving air from the air mattresses. The internal volumes of the bladders are changed to adjust the pressure of the air in the air mattresses. Other control mechanisms operable to adjust the inflation of air mattresses are disclosed in U.S. Pat. Nos. 3,605,138; 3,784,994; and 3,882,425.

SUMMARY OF THE INVENTION

The invention is an apparatus for supplying fluid, such as air, under pressure to fluid accommodating means and adjusting the fluid pressure in the fluid accommodating means. Pump means operated with an electric powered means provides a supply of fluid under pressure. A control means connects the electric powered means to a source of electric power to operate the pump means, and receives the fluid from the pump means and directs the fluid to the fluid accommodating means. The control means includes valve means operable to vent fluid from the fluid accommodating means.

According to the invention, there is provided an apparatus for supplying air under pressure to one or more air mattresses used as a body support in an air bed. The apparatus comprises an air pump having a movable member. An electric powered means connected to the movable member operates to move the member thereby pumping air. The air is carried in air line means to control means. A second air line means connects the control means to the air mattress. The control means has a normally closed first valve and a normally open switch connecting a source of power to the electric powered means when the switch is closed. The first valve when moved to the open position connects the pump means to the air mattress and closes the switch whereby the pump means operates to pump air under pressure through the first valve into the air mattress. The pump means continues to dispense air as long as the switch is closed. When the first valve is returned to its closed position, the switch is opened thereby cutting off the electric power to the electric powered means and stopping the pump means. The closed first valve blocks the flow of air out of the air mattress.

The control means has a normally closed second valve blocking a passage open to atmosphere. When the second valve is moved to its open position, air from the air mattress is vented to atmosphere thereby reducing the firmness of the air mattress.

The control means are hand operated units that are used with air beds to regulate inflation of each air mattress in the air bed. Each unit is manually operated to control the air pump and regulate the air supply of one air mattress. The firmness of each air mattress of the air bed can be independently adjusted to satisfy the comfort desires of the user. Each unit is provided with flexible hook elements operable to releasably mount the control means on a fabric or like support.

DESCRIPTION OF DRAWING

FIG. 2 is a diagrammatic view of the air control apparatus showing the air pump in section connected to a pair of air mattresses;

FIG. 7 is an enlarged sectional view taken along line 7—7 of FIG. 5.

DESCRIPTION OF PREFERRED EMBODIMENT

Figure 1:
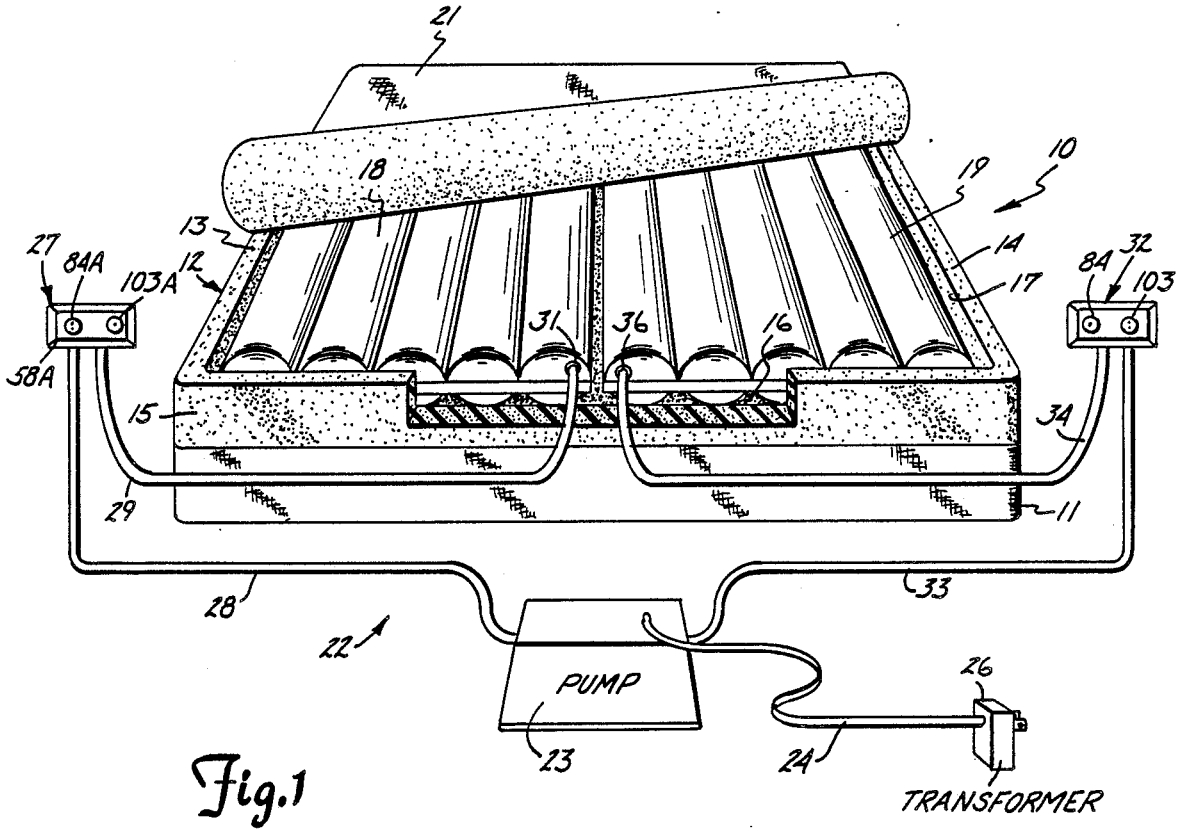
FIG. 1 is a perspective view of an air bed, partly sectioned, and an air control apparatus of the invention for the air mattresses of the air bed.

Referring to FIG. 1, there is shown a resilient support indicated generally at 10 having a generally horizontal surface for supporting an object. Support 10 is preferably an air bed to accomodate one or more persons. Support 10 has a generally rectangular base or box spring unit 11 adapted to be supported on a floor or frame engaging the floor. A mattress unit indicated generally at 12 is located on top of box spring unit 11. Mattress unit 12 has a generally panshaped resilient member having upright linear side edges 13 and 14 joined to a transverse front edge 15. A similar transverse edge joins the rear or foot end of side edges 13 and 14. Edges 13 to 15 are integral with the peripheral portions of the generally flat bottom 16 and form therewith a generally rectangular chamber 17. A pair of side-by-side longitudinal air bladders 18 and 19 are located in chamber 17. The air bladders 18 and 19 are conventional air mattresses or air bags having a plurality of longitudinal chambers adapted to accommodate air under pressure. The air bladders 18 and 19 are of a size to fill chamber 17 with the outside of air baldder 18 located adjacent the inside of side edge 13. The outside of air bladder 19 is located adjacent the inside surface of edge 14. Opposite ends of the air bladders 18 and 19 are located adjacent the front and rear edges so that the air bladders 18 and 19 fill chamber 17 when they are inflated. The air bladders are made of fabric bonded to vinyl sheet material. Bladders 18 and 19 may have X or I beam construction. The air bladders vary in size from 23 to 34 inches wide and 67 to 84 inches long. Preferably, the air bladders 18 and 19 have an inflated thickness of 5.5 inches. Other types and sizes of air bladders can be used as air mattresses for air bed 10.

A generally rectangular cover 21 fits over edges 13 to 15 to enclose the top of chamber 17. Cover 21 rests on top of air bladders 18 and 19. As shown in FIG. 1, a portion of the cover 21 has been rolled back to illustrate the side-by-side relationship of air bladders 18 and 19 in chamber 17.

An air control apparatus indicated generally at 22 functions to provide air under pressure to bladders 18 and 19 and control the pressure of the air therein. Air control apparatus 22 has an air pump 23 operable to supply air under pressure to inflate bladders 18 and 19. An electrical line or cord 24 connects pump 23 to a transformer 26. Transformer 26 is adapted to be plugged into a conventional 110 AC electrical outlet receptacle to connect the pump 23 to a low voltage DC electrical current.

A first hand control 27 functions to regulate the air pressure in air bladder 18. A flexible tubular line or tube 28 connects the air outlet pump 23 to hand control 27. A second flexible line or tube 29 joins hand control 27 to an inlet connector 31 of air bladder 18. Lines 28 and 29 are flexible and have a length such that hand control 27 can be conveniently operated by a person lying on the air bed.

The pressure of the air in air bladder 19 is controlled with a second hand control 32. A first tubular line or tube 33 connects the air outlet of pump 23 with control 32. A second tubular line or tube 34 connects hand control 32 to a connector 36 of air bladder 19. Second hand control 32 functions independently of hand control 27 to regulate the pressure of air in air bladder 19. Hand controls 27 and 32 can be operated concurrently to control the air pressure in both bladders 18 and 19. Hand controls 27 and 32 can be mounted on side panels of the air bed.

Referring to FIG. 2, pump 23 is a reciprocating diaphragm pump having a housing or casing 37 and a central generally horizontal wall 38. Wall 38 divides housing 37 into a pumping chamber 39 and a motor chamber 41. Pumping chamber 39 is separated into two chambers 39A and 39B with a generally flat flexible diaphragm 42. The outer peripheral edges of the diaphragm are clamped onto housing 37. A reciprocating electric motor or vibrator 43 is located in motor chamber 41. Motor 43 has a reciprocating core 44 connected to a rod 46. Rod 46 extends through the hole in wall 38 and is connected to the center portion of diaphragm 42 with a pair of nuts 47 and 48. A coil 49 surrounds core 44. The center of coil 49 has a cylindrical chamber accommodating core 44. An electronic control 51 located in chamber 41 is connected to coil 49 and the power supply line 24. Control 51 has switching circuits which change the direction of current flow in coil 49 thereby causing core 44 to reciprocate. The reciprocating core 44 causes diaphragm 43 to move up and down, as shown by the arrow 50. A reciprocating piston pump or a motor driven blower can be used to supply air under pressure.

A one-way inlet valve 52 allows air to flow into the pumping chamber 39A when diaphragm 42 is moved in an upward direction. A one-way outlet valve 53 allows air to flow from chamber 39A into tubular member 28 when the diaphragm 42 moves in a downward direction. Valve 52 will close when valve 53 opens. A second one-way valve 54 mounted on housing 37 allows air to flow into pumping chamber 39B when diaphragm 42 is moved in a downward direction. A one-way outlet valve 56 allows the air in chamber 39B to flow into the tubular member 33 leading to the hand control 32. The reciprocating or up and down movement of diaphragm 42 functions to draw air into chambers 39A and 39B and pump the air out of chambers 39A and 39B into tubular members 28 and 33 leading to the hand controls 27 and 32.

Hand controls 27 and 32 are identical in structure and function. The following description is limited to hand control 32. As shown in FIGS. 3 to 7, hand control 32 has a body 57 of non-conductive plastic carrying a cap or cover 58.

The lower edge of body 57 has a peripheral outwardly directed lip 59 engaging the lower edges of the sides and ends of cover 58. The bottom of body 57 is flat. A generally rectangular pad of flexible hook elements 61 is attached to the flat bottom with a suitable adhesive. Screws or other types of fasteners can be used to attach pad 61 to body 57. Hook elements 61 releasably cling to fabrics, so that control 32 can be attached to sheets, blankets and quilts used on air beds.

Figure 6:
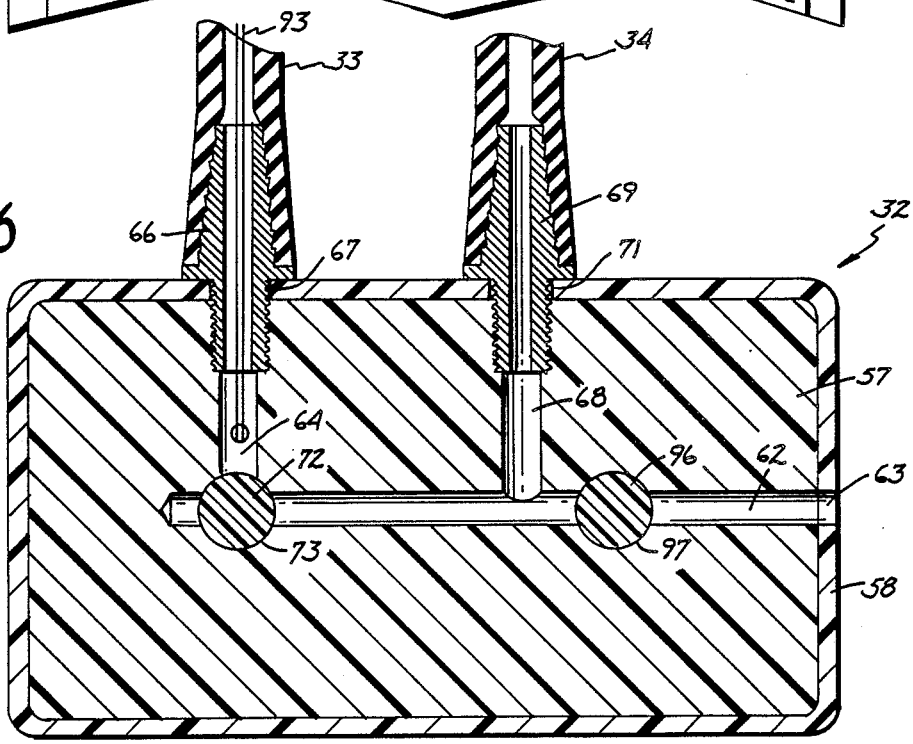
FIG. 6 is a sectional view taken along line 6—6 of FIG. 5.

As shown in FIG. 6, body 57 has a generally horizontal longitudinal main passage 62 aligned with a hole 63 in an end wall of cover 58. A first lateral passage 64 intersects the inner end of main passage 62. A nipple 66 having a passage extends through a hole 67 in the side wall of cover 58 aligned with passage 64. Nipple 66 is threaded into body 57 and against the side wall of cover 58. The tubular member or hose 33 fits over nipple 66 to provide air communication with passage 64 and the passage in tubular member 33.

A second lateral passage 68 intersects the mid-section of main passage 62. A nipple 69 having a longitudinal passage projects through a hole 71 in side wall of cover 58 and is threaded into body 57 in alignment with passage 68. The tubular member or hose 34 fits onto nipple 69 to provide an air passage between the passage 68 and the passage in tubular member 34.

Figure 5:
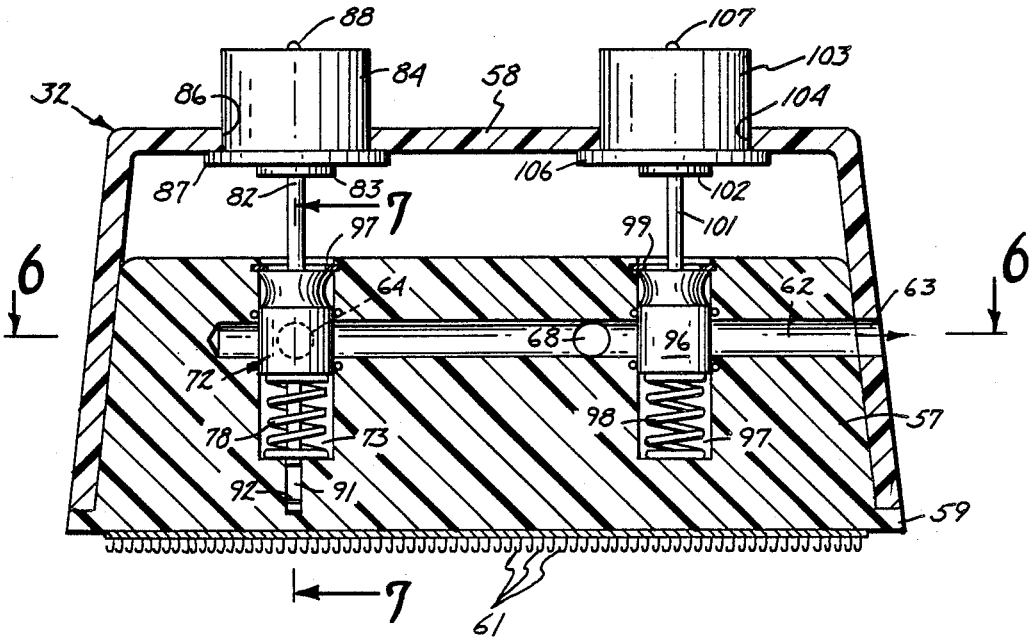
FIG. 5 is a sectional view taken along line 5—5 of FIG. 3.
Figure 3:
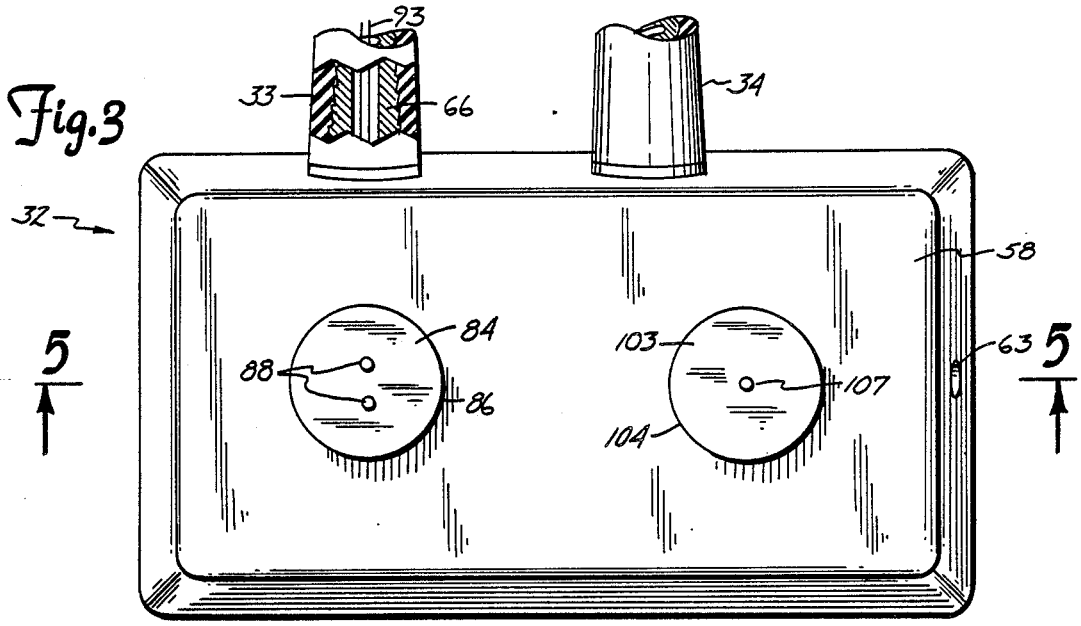
FIG. 3 is an enlarged top view of a hand control of the air control apparatus.
Figure 4:
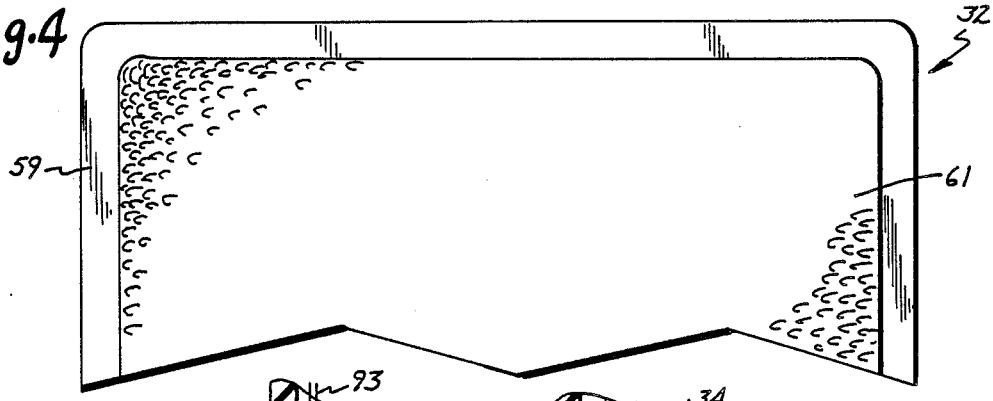
FIG. 4 is a fragmentary bottom view of FIG. 3.

As shown in FIGS. 5 and 6, a first spool valve 72 is slidably disposed in a bore 73 that intersects the juncture of passages 62 and 64 to block the flow of air from passage 64 to passage 62, which is in communication with the air bladder 19 via the nipple 66 and hose 34.

As shown in FIG. 7, spool valve 72 has a cylindrical section 74 and a groove section 76. A split ring 77 located in the upper end of bore 73 and seated into an annular groove in body 57 holds spool valve 72 in sliding assembled relation with bore 73. A coil spring 78 located in the bottom of bore 73 biases spool valve 72 to an up and closed position. A pair of O-rings 79 and 81 engage opposite portions of cylindrical section 74 when valve 72 is in the closed position to prevent leakage of air from passages 62 and 64 to the atmosphere. Returning to FIG. 5, an upwardly directed rod 82 is secured to the top of groove section 76. Returning to FIG. 5, upper end of rod 82 has a generally cylindrical head 83. The head 83 engages the lower side of an actuator or button 84. Button 84 has a cylindrical member that is slidably disposed in a hole 86 in the top of cover 58. The lower portion of button 84 has an outwardly directed flange 87 that bears against the bottom of the top of cover 58 when button 84 is in the up position and spool valve 72 is in the closed position. The top surface of button 84 has a pair of upwardly directed projections 88 that function as digital sensing indicia that allow a person to digitally sense button 84 without visually observing it.

Returning to FIG. 7, a downwardly directed cylindrical finger 89 is secured to the bottom of cylindrical section 74. Finger 89 extends into a downwardly directed hole 91. Electrical switch contacts 92 located in the bottom of hole 91 are adapted to be actuated on engagement with the finger 89. Switch contacts 92 comprise a normally open electric switch. Switch contacts 92 are coupled to electrical lines 93 that extend through a passage 94 into passage 64. Electrical lines 93 pass through nipple 66, as shown in FIG. 6, and the passage in tubular member 33 to one-way valve 56. As shown in FIG. 2, an electrical line 95 connected to line 93 at valve 56 leads to solenoid coil control 51. When switch contacts 92 are closed by depressing button 84, the control 51 is energized, whereby coil 49 reciprocates core 44 which moves flexible diaphragm 42 in opposite directions to effect the movement of air into and out of chambers 39A and 39B. When the button 84 is depressed, groove section 76 is located in alignment with passages 62 and 64 whereby the air under pressure from pump 23 flows through the hand control 32 and tubular member 34 to inflate the air mattress 19. The firmness of the air bladder 19 is a function of the amount and pressure of the air supplied thereto. This firmness can be regulated by the duration in which button 84 is depressed.

A second spool valve 96, shown in FIGS. 5 and 6, is slidably disposed in a bore 97 intersecting main passage 62 between passage 68 and the outlet end of main passage 62. Spool valve 96 is identical in construction to spool valve 72. As shown in FIG. 7, valve 96 has a cylindrical portion and a grooved portion. A spring 98 in the bottom of bore 97 biases spool valve 96 in an upward closed position against a split ring 99 located in the upper end of bore 97 and seated in a groove in body 57. The upper end of spool valve 96 has an upwardly directed rod 101 terminating in a generally cylindrical head 102. Head 102 engages the bottom of a button 103. Button 103 is a cylindrical actuator that is slidably disposed in circular hole 104 in the top of cover 58. The bottom of button 103 has an outwardly directed flange 106 that bears against the inside of the top of cover 58. Spring 98 functions to bias button 103 in an upward direction. The top of button 103 has a projection 107 that serves as a digital sensor to facilitate the location of the button without visual observation. Projection 107 can be deleted from button 103. The smooth top of button 103 can function as a digital sensor since projections 88 identify button 84.

Button 103 is depressed to open to spool valve 96. When the groove portion of spool valve 96 is aligned with main passage 63, the passage 63, as well as the lateral passage 64, is open to the atmosphere through hole 63 and cover 58. The air under pressure in air bladder 19 can vent through hand control unit 32, whereby the operator can adjust the softness of the air bladder 19.

Hand control 27 has a pair of buttons 84A and 103A. When button 84A is depressed, the spool valve associated with the button is open and the switch is turned on, whereby the pump 23 operates to pump air via hose 28 to hand control 27. The air flows through the hand control 27 into hose 29 to increase the pressure of the air in air bladder. This firms the air bladder. The air bladder 18 can be softened by allowing the air to evacuate from it through hose 29 and hand control 27. Button 103A is depressed, whereby the air can flow through the hand control 27 to the atmosphere.

While there is shown and described a preferred embodiment of the apparatus for supplying a fluid to one or more fluid receivers, as air mattresses, it is understood that changes in the pump, air mattresses, and valve assembly can be made by one skilled in the art without departing from the invention. The invention is defined in the following claims.

The embodiments of the invention in which an exclusive property or privilege is claimed are defined as follows:

1. An apparatus for supplying air under pressure to an air mattress and regulating the pressure of the air in the air mattress comprising: pump means operable to supply air under pressure, electric powered means for operating the pump means, control means for controlling the electric power to the electric powered means and the flow of air from the pump means, hose means connecting the pump means with the control means and the control means with the air mattress for carrying air from the pump means to air mattress via the control means, said control means having first means operable to selectively allow air flow from the pump means through the control means to the air mattress and block the flow of air from the air mattress, switch means for connecting the electric powered means to a source of electric power, said switch means being operated by the first means in response to movement of the first means to a position where the first means allows air to flow to the air mattress to connect the electric powered means to a source of electric power thereby operating the pump means, and second means separate from the first means operable to vent air from the air mattress thereby regulating the pressure of the air in the air mattress.

2. The apparatus of claim 1 wherein:

the pump means includes a chamber, diaphragm means located in said chamber, and one-way valve means operable to allow air to move into and out of the chamber in response to movement of the diaphragm means, said electric operated means being connected to said diaphragm means.

3. The apparatus of claim 2 wherein:

the electric operated means includes a reciprocating core, coil means surrounding the core, and control means for connecting the coil means to a source of electric power.

4. The apparatus of claim 1 wherein:

the control means includes a body and hook elements attached to a portion of the body for releasably holding the control means on a fabric support.

5. The apparatus of claim 1 wherein:

the control means includes a first valve movable from a closed position to an open position to allow air to flow from the pump means to the air mattress, said first valve operating said switch means when the first valve is in the open position, and a second valve movable from a normally closed position to an open position to vent air from the air mattress thereby regulating the air pressure in the air mattress.

6. The apparatus of claim 5 wherein:

said first valve includes a movable spool valve and a hand operated button for moving the spool valve, said spool valve having means for operating the switch means when the button is operated.

7. The apparatus of claim 1 wherein: said control means including a body having a passage, said hose means includes a first hose connecting the passage with the pump means and a second hose connecting the passage with the air mattress, a first valve located in said passage movable to a first position to block the flow of air from the first hose to the second hose and movable to a second position to allow air to flow from the first hose to the second hose, and a second valve located in said passage movable to a first position to block the flow of air from the passage to atmosphere and movable to a second position to allow air to flow from the passage and second hose to atmosphere thereby venting air from the air mattress.

8. The apparatus of claim 7 including:

hook elements attached to a portion of the body.

9. The apparatus of claim 7 including:

a cap attached to the body, a first button movably mounted on the cap for operating the first valve, and a second button movably mounted on the cap for operating the second valve.

10. The apparatus of claim 7 including:

electric line means located within the first hose connected to the switch means.

11. The apparatus of claim 7 including:

biasing means operable to bias the first and second valves to their first positions.

12. An apparatus for supplying fluid under pressure to means for accommodating fluid under pressure comprising: pump means operable to supply fluid under pressure, power means for operating the pump means, control means for controlling the power means and flow of fluid from the pump means to the means for accommodating fluid under pressure, said control means having first means movable to a first position to allow flow of fluid from the pump means to the control means and then to the means for accommodating fluid under pressure and to a second position to block the flow of fluid from the means for accommodating fluid under pressure, and switch means operated by the first means when the first means is in the first position to connect the power means to a source of power thereby operating the pump means when the first means allows fluid to flow from the pump means to the means for accommodating fluid, and second means separate from the first means operable to allow fluid to flow from the means for accommodating fluid under pressure.

13. The apparatus of claim 12 wherein:

the control means includes a body, and hook elements attached to a portion of the body for releasably holding the control means on a fabric support.

14. The apparatus of claim 12 wherein:

the first means is a valve movable from a closed position to an open position to allow fluid to flow from the pump means to the means for accommodating fluid under pressure, said valve operating said switch means when the valve is in the open position.

15. The apparatus of claim 12 wherein: the second means is:

a valve movable from a closed position to an open position to allow fluid to vent from the means for accommodating fluid under pressure.

16. The apparatus of claim 12 wherein:

the control means includes a body having a passage, said first means comprising first valve means selectively operable to control the flow of fluid from the pump means to the means for accommodating fluid, said first valve means operating the switch means when fluid flows from the pump means to the means for accommodating fluid and second valve means operable to vent fluid from the means for accommodating fluid.

17. The apparatus of claim 1 wherein: the control means has a body having a passage for carrying air from the pump means and to and from the air mattress, a first valve located in said passage movable to a first position to block the flow of air to and from the air mattress and movable to a second position to allow air to flow from the supply of air to the air mattress, and said second means including a second valve located in said passage movable to a first position to block the flow of air from the air mattress and movable to a second position to allow air to vent from the air mattress.

18. The apparatus of claim 17 including:

a cap attached to the body, a first button movably mounted on the cap for operating the first valve, and a second button movably mounted on the cap for operating the second valve.

19. The apparatus of claim 18 wherein:

the cap has a top wall accommodating the first and second buttons, and a side wall surrounding the body.

20. The apparatus of claim 17 including:

hook elements attached to a portion of the body for releasably holding the control apparatus on a fabric support.

* * * * *